2/17/81 XR 4,251,589

United States Patent [19]

Romaniec

[11] 4,251,589

[45] Feb. 17, 1981

[54] PRODUCTION OF A SUBSTANTIALLY INERT FLEXIBLE TEXTILE MATERIAL

[76] Inventor: Charles Romaniec, Woodville Flat, Woodville House, Lurgan, Craigavon, Northern Ireland

[21] Appl. No.: 72,602

[22] Filed: Sep. 5, 1979

Related U.S. Application Data

[63] Continuation of Ser. No. 967,092, Feb. 8, 1980, abandoned, which is a continuation of Ser. No. 830,748, Aug. 29, 1977, abandoned.

[51] Int. Cl.[3] ..... B32B 23/02; B32B 27/02; D03D 25/00; D06B 19/00

[52] U.S. Cl. ..... 428/263; 8/115.6; 8/115.7; 423/447.1; 427/55; 427/176; 427/227; 427/228; 427/377; 428/264; 428/265; 428/367; 428/408; 428/921

[58] Field of Search ..... 427/227, 228, 394, 176, 427/55, 377; 428/921, 408, 367, 264, 265; 8/115.6; 423/447.1

[56] References Cited

U.S. PATENT DOCUMENTS

| | | | |
|---|---|---|---|
| 3,027,222 | 3/1962 | Wilkinson | 427/227 |
| 3,235,323 | 2/1966 | Peters | 8/116.2 |
| 3,242,000 | 3/1966 | Lynch | 427/227 |
| 3,356,525 | 12/1967 | Gutzeit | 427/227 |
| 3,416,874 | 12/1968 | Robin | 423/447.5 |
| 3,497,318 | 2/1970 | Noss | 423/447.5 |
| 3,556,712 | 1/1971 | Yoneshige et al. | 8/116 |
| 3,556,729 | 1/1971 | Holsten et al. | 427/227 |
| 3,639,140 | 2/1972 | Miyamichi | 427/227 |
| 3,647,770 | 3/1972 | Gump et al. | 427/227 |
| 3,661,616 | 5/1972 | Miyamichi | 427/227 |
| 3,790,393 | 2/1974 | Cowland et al. | 427/227 |
| 3,803,056 | 4/1974 | Hart | 252/478 |
| 3,820,951 | 6/1974 | DiEdwardo et al. | 8/115.5 |
| 3,972,984 | 8/1976 | Iizoka et al. | 264/29.2 |
| 4,054,704 | 10/1977 | Vassiliov | 427/145 |

*Primary Examiner*—Ronald H. Smith
*Assistant Examiner*—Janyce A. Bell
*Attorney, Agent, or Firm*—Bell, Seltzer, Park & Gibson

[57] ABSTRACT

A partially carbonized inert fibrous flexible textile material is obtained when a scoured textile material which is a blend of a fibrous acrylonitrile polymer and a fibrous regenerated cellulosic material is impregnated with an aqueous solution of salts which salts are either (a) an ammonium halide and a lower copper alkanoate or (b) an ammonium phosphate and an alkali metal bichromate, the impregnated material heated in a stream of an oxygen-containing gas at 150°-250° C. and then further heated in a stream of inert gas so as to produce a surface temperature on the fibres of 275° to 325° C. and thus rendered substantially uniformly inert.

10 Claims, 3 Drawing Figures

PRODUCTION OF A SUBSTANTIALLY INERT FLEXIBLE TEXTILE MATERIAL

This is a continuation of application Ser. No. 967,092, filed Feb. 8, 1980 now abandoned, which is a continuation of application Ser. No. 830,748 filed Aug. 29, 1977, now abandoned.

This invention relates to the production of an inert, partially carbonised, fibrous, flexible textile material.

An object of the invention is to produce a material which has chemical inertness, non-flammability, and good thermal and electrical insulation properties and at the same time possesses sufficient tensile strength to be used in the manufacture of protective garments or other articles and which is substantially free from any tendency to generate static electrical charges. This conjoint presence of properties is desirable in, for example, protective clothing and as a reinforcement for synthetic resins used in the manufacture of pipes and vessels for conveying and storing corrosive fluids.

SUMMARY

The present invention provides a process for the production of partially carbonised, inert fibrous textile material which process comprises impregnating a scoured textile material formed from a blend of fibrous acrylonitrile polymer and a regenerated fibrous cellulosic material with either (i) an aqueous solution containing an ammonium halide and a copper salt of a lower alkanoic acid or (ii) an ammonium phosphate and an alkali metal bichromate, heating the impregnated product in a stream of an oxygen-containing gas to a temperature of 150°-250° C., preferably for from 80-120 minutes, and then heating the thus treated product in an inert gas atmosphere so as to give a surface temperature on the product of 275°-325° C. and for a time sufficient to render the surface of the fibrous product substantially uniformly inert.

DESCRIPTION

The preferred textile materials for use in the present procedure are woven textile materials containing 70 to 40% of fibrous acrylonitrile polymer and 30 to 60% of fibrous regenerated cellulose, preferably 55 to 45% of acrylonitrile polymer and 45 to 55% of regenerated cellulose. A convenient woven textile material is one containing equal proportions by weight of fibrous acrylonitrile polymer and fibrous regenerated cellulose.

The acrylonitrile polymer used may be a fibre-forming polyacrylonitrile or a fibre-forming copolymer or terpolymer of acrylonitrile containing a major proportion of acrylonitrile units. The copolymerising monomer or monomers may be a vinyl aromatic hydrocarbon such as styrene, α-methylstyrene or vinyl naphthalene, a vinyl or acrylic ester such as vinyl acetate, methyl methacrylate, ethyl acrylate or vinyl chloride, a vinyl alkyl or aryl ether such as vinyl ethyl ether or vinyl phenyl ether or an alkene such as ethylene or propylene. It is preferred that such copolymers or terpolymers contain at least 65% by weight and more preferably at least 85% by weight of acrylonitrile units. A typical copolymer is one containing 97% by weight of acrylonitrile units and 3% by weight of vinyl acetate units as well as the textile fibres sold under the Registered Trade Marks "Courtelle" and "Dralon T".

The regenerated cellulose used may be cuprammonium rayon or a viscose rayon.

Yarns and woven textile materials such as ribbons and fabrics woven from yarns of the aforesaid polymers and regenerated cellulose constitute the starting materials for the process of the present invention. The yarns are preferably formed from continuous filament materials but staple fibres or other fibres having a length of 10 cm. or more are also conveniently used.

Prior to use in the present process the material used should be thoroughly scoured so as to remove any adjuvents remaining on the yarns or filaments from previous processing. An aqueous solution of ammonium hydroxide is suitable for this purpose. After scouring the material is preferably dried.

The scoured material is then given a treatment with one of two alternative aqueous treating baths. The first of these baths contains an ammonium halide and a copper salt of a lower alkanoic acid, preferably one having 15-25% by weight of ammonium chloride and 1-10% by weight of copper acetate. The ammonium chloride may be replaced by ammonium bromide and the copper acetate by copper propionate. This treatment is preferably carried out at raised temperature: temperatures of 70°-100° C. are most suitable but lower temperatures may be used with longer times of treatment. The second alternative of the two aqueous treating baths is one containing an ammonium phosphate and an alkali metal bichromate, preferably one using 0.5 to 2.5% by weight of ammonium phosphate and 15-25% by weight of potassium bichromate. This bath is also preferably used at the raised temperature indicated for the alternative bath. At the raised temperatures contemplated a treating time of 15 minutes has been found to be sufficient but at lower temperatures longer treating times are necessary, e.g. up to one hour.

The thus treated material, after drying, is then subjected to a heat treatment in a stream of an oxygen-containing gas, e.g. air, commencing at 150° C. and gradually rising to 250° C. during the course of 80-120 minutes. This treatment is carried out whilst maintaining the material undergoing treatment under longitudinal tension. The previous treatment with one of the baths containing the chemical reagents serves to prepare the material for this oxidative treatment during the course of which its colour changes from white or cream to a golden brown to rust colour. The two kinds of fibres undergo partial pyrolysis but this is believed to be largely confined to the surface layers of the constituent fibres. Some shrinkage takes place but there is little change in the weight per unit area of the treated and untreated materials. Thus the loss in weight is substantially equal to the shrinkage. It is preferred to carry out the greater part of the heat treatment at temperatures between 180° and 220° C. for a period up to 2 hours.

After completion of the heat treatment described above the material is then transferred to an oven in which a further heat treatment is applied but this treatment is carried out in an inert gaseous atmosphere and at a temperature somewhat higher than that employed in the preceding oxidative heat treatment. It has been found convenient to employ infra-red heat treatment so as to bring the surfaces of the fibres, and possibly the layers immediately underlying the surface to temperatures within the range of 275 ° to 325° C. Such heat treatment results in some further volatilisation of the contents of the fibres with a further darkening of the colour which becomes substantially black. The fibres are rendered inert but retain their flexibility. The finished goods have an appearnace (apart from change of colour) which is very similar to that of the untreated goods but somewhat more closely woven and substantially black throughout.

The second heat treatment in an inert gaseous atmosphere may be continued for about 1 to 2 hours. It is important that the whole of the surface of the fibres should assume substantially the same black colour and acquire a uniform degree of inertness and non-flammability.

The heat treatment may be carried out by passing the material undergoing treatment through a zone containing an inert gaseous atmosphere whilst maintaining the surfaces of the fibres at the indicated values. The inert gaseous atmosphere may be an atmosphere of nitrogen or argon.

The first bath may be a 30% by weight solution of the specified salts in water of which at least 21% by weight may be ammonium chloride and the remainder copper acetate.

After treatment by the first bath and prior to heating it is preferred to submit woven fabric to a tumbling action in order to ensure, as far as possible, that there is no adhesion between adjoining threads and fibres in woven textiles when these are used.

The stream of oxygen-containing gas used for the first heat treatment should pass over the surface of the fibres and threads sufficiently rapidly to ensure that any gaseous reaction products formed are rapidly removed from their site of formation or evolution. It will however be understood from the conditions employed that a limited pyrolysis of the fibres is contemplated and the treatment is much less severe than that applied to similar fibres in the formation of carbon fibres in which latter case a substantially uniform and severe pyrolysis is carried out throughout the depth of the fibres and a rigid product is ultimately produced. The maximum temperature employed in the present process is much lower than those utilised in the pyrolysis of similar fibres for the production of carbon fibres.

As already indicated it is preferred to carry out the treatment in an oxidising atmosphere under longitudinal tension. This results in a progressive transverse shrinkage and in a substantially dimensionally stabilized material.

A preferred method of carrying out the second heat treatment according to the present invention will now be described with reference to the accompanying drawings.

FIG. 1 of the drawings is a flow diagram illustrating the passage of a suitable textile fabric through the successive steps in the process. A roll of fabric 101 is passed in turn through a scouring bath 102, between the nip of a pair of rollers 103, then through the impregnating bath 104, between the nip of a second pair of rollers 105, then through an oven 106 through which a stream of an oxygen-containing gas is continuously flowing, between the nip of a third pair of rollers 107 and finally into the furnace 11 which is more particularly illustrated in FIGS. 2 and 3 of the drawings.

The textile fabric may be woven from a 50–50 blend of polyacrylonitrile and viscose rayon fibres.

At the nip between the rollers 103 the scouring liquid is, as far as possible, removed from the material undergoing treatment. A water wash may be inserted after rollers 103 in order still further to remove residual scouring liquid from the fabric and may be succeeded by an additional pair of rollers (not shown) between which the fabric passes in order to control the amount of moisture present in the fabric when it is introduced into impregnating bath 104. After passage about a roller in bath 104 the take-up of impregnating liquid is controlled by passage between the nip of a pair of rollers 105. After passage through rollers 105 the fabric containing a controlled amount of impregnating liquid passes into the oven 106 where it is in contact at a controlled temperature with a stream of oxygen-containing gas which removes gaseous oxidation products as formed from the surface of the fibres. On leaving the oven the fabric passes between the nip of an additional pair of rollers 107. The combined action of the two pairs of rollers 105 and 107 applies the desired longitudinal tension to the fabric whilst it is being subjected to heat treatment in oven 106. The fabric then passes over guide rollers 5 into furnace 11 which is diagrammatically shown in FIGS. 2 and 3 of the drawings.

FIG. 2 is a diagrammatic side view of an infra-red oven for use in the process of the invention; and FIG. 3 is an end view of part of the oven of FIG. 2.

In FIGS. 2 and 3 fabric which has been subjected to pyrolytic heat treatment in oven 106 is passed over guide rollers 5 into a trough 7 containing an inert liquid which is a normally liquid perfluoroalkane or a perfluorocycloalkane or a mixture thereof. This liquid acts as a liquid seal to prevent entry of oxygen into furnace 11, as the casing 11 of the furnace has a neck portion which dips into the inert liquid in the trough and thus provides the only means of entry and egress from the furnace for material under treatment.

The fabric 4 then passes over further rollers within the furnace case 11 beneath an array of electrically operated infra-red emitting elements 3 which have their main emission band at from 2–3$\mu$, with the peak of their emission at 2.8$\mu$. Such infra-red radiations have particularly deep penetrative powers, and heat the whole of the fibres substantially uniformly. The part of the furnace containing the elements 3 is lined with curved quartz vitreosil reflectors 1, which focus the infra-red radiation onto the two passages which the fabric makes through the furnace. The infra-red microwave radiation is absorbed by the material, which is thus directly heated by the radiation. This initiates and maintains a controlled elimination of vapours and carbonisation of the material. The elements 3 are held in grooves in the infra-red vitreosil reflector. The fabric passes around a terminal roller at the right hand end of the furnace, and then returns in the reverse direction finally passing through the fluid seal 6 in trough 7 and then out, over suitable guide rollers on to a take-up roller 13. The inert gas is introduced through inlets 9, circulates within furnace 11 and is withdrawn through outlet 10, through which any vapours emitted by the fibres undergoing conversion are also removed. The withdrawn fabric is black, flexible, inert and non-flammable when exposed to a naked flame.

After irradiation with infra-red radiation to substantial inertness the fabric is ready for finishing in any manner.

DETAILED DESCRIPTION

The following specific example illustrates the manner in which the invention may be performed.

EXAMPLE

A medium weight woven fabric woven from a blend of equal weights of viscose rayon and polyacrylonitrile fibres was impregnated in a bath with an aqueous solution at 91° C. comprising by weight 70% water, 23% of ammonium chloride and 7% of copper acetate.

The impregnated fabric was dried at 60° C., then flexed and tumbled for 10 minutes to loosen any matted fibres.

Figure 1:
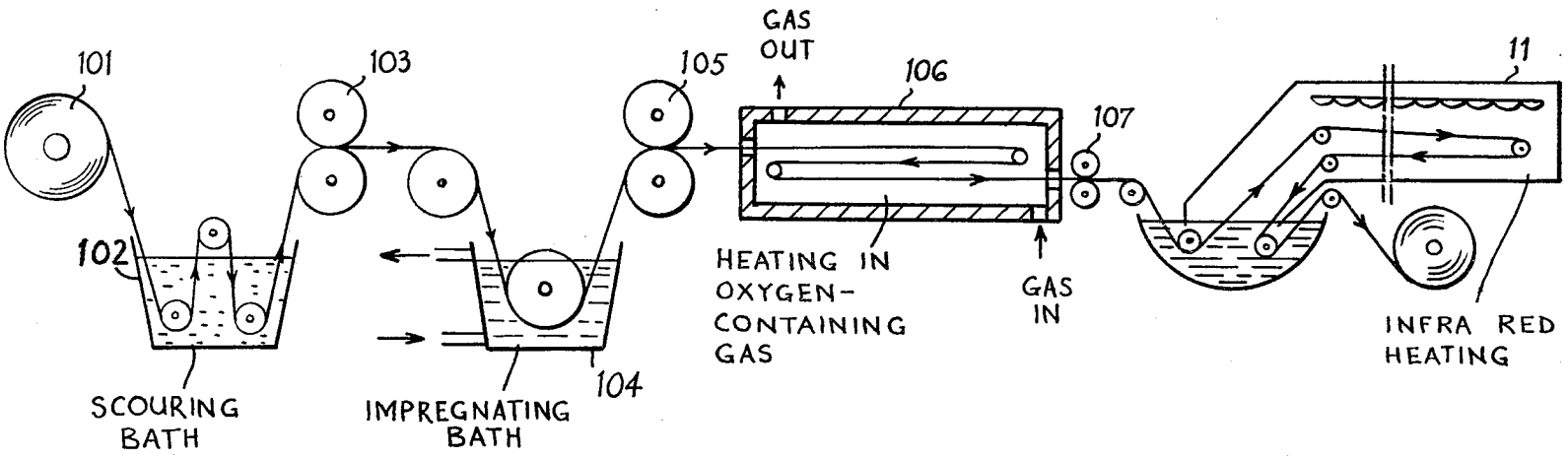
Figure 2:
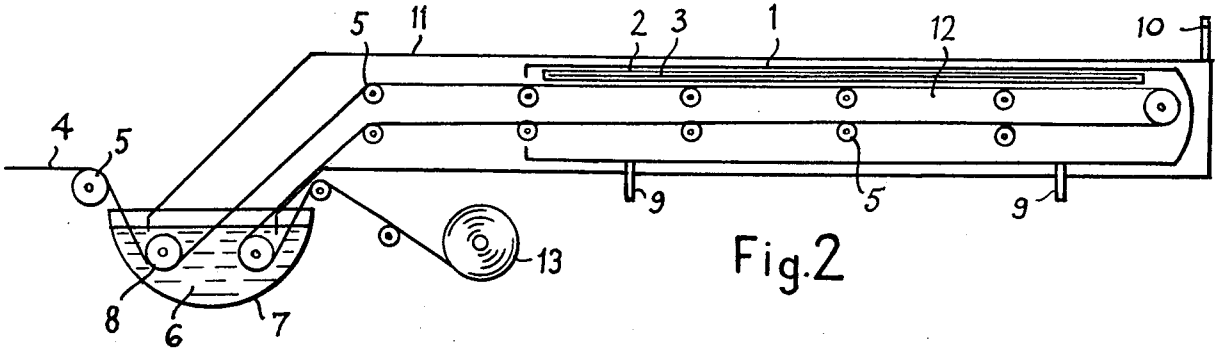
Figure 3:
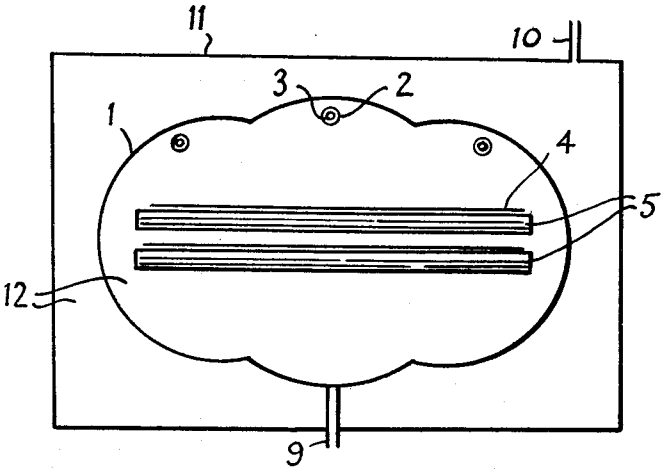

The fabric was then fed under tension in the direction of the warp yarns into an oven 106 wherein it was heated for 80 minutes the temperature rising from 150° C. to 200° C. with free passage of air over the surface of the fabric. After removal from this oven, it was fed continuously into the oven 11 shown in FIGS. 2 and 3, wherein it had a dwell time of 110 minutes. In this oven a temperature of substantially 280° C. was maintained throughout by means of infra-red radiation.

On emerging from the oven, the fabric was batched.

The product of the process was dimensionally stable, tear resistant, had a negligible heat and electrical conductivity and low latent heat.

By the method of the invention twilled textile fabrics have been produced having weights between 170 and 370 grams per square meter and thicknesses between 0.5 and 1.7 millimeters. The specific gravity of the products obtained have been between 1.50 and 1.60. The material does not melt and can be exposed to the temperature of an oxyacetylene torch without bursting into flame. The electrical resistance is about $10^{13}$ ohm/ch. The thermal conductivity k is about 28–30 milliwatts/meter°C.

When tested for flammability by the method of British Standard Specification No. 2963 (1958) in its unwashed state and after having been subjected to repeated washing in accordance with Appendix A to British Standard Specification No. 3121 (1959) an applied flame was not propagated.

The inert material produced by the process of the invention can thus be used for protective clothing, suitable for use against high intensity radiation, heat and direct flame. Since the material has very low heat retention and transmission and low electrical conductivity it can also be used in the construction of special purpose pipes and for the thermal lagging of pipes. A pipe can be made by winding a continuous strip of the material on a mandrel and binding it with a synthetic resin. Such a pipe is suitable for use with corrosive liquids.

Garments made from the inert material are capable of civilian and military uses involving protection against flash, flame and radiations, including microwave radiations.

The inert material produced as described above may additionally be subjected to a finishing process. It may be coated on one or both sides by deposition of particles of a volatilisable metal making use of a metal volatilisation process. As an example an aluminium wire may be vaporised in a vacuum and the volatilised particles allowed to coat a fabric produced as described above. The volatilised particles become permanently attached to the surface of the material. A further layer of particles may become attached thereto upon continuing the procedure. Such treatment serves to minimise abrasion of the surface of the inert material in use and to minimise oil and water absorption by the material.

Aluminium of 99.99% purity having a melting point of 800° C. can be evaporated at $3\times10^{-4}$ torr utilising ionic bombardment of the material for 10 minutes using thermal energy of about 3 kv.

Whilst the above example utilises a polyacrylonitrile-viscose rayon fabric it will be understood that fabrics made from an acrylonitrile polymer and regenerated cellulose in proportions other than equal weights may be similarly processed to give similar products.

What is claimed is:

1. A process for the production of a partially carbonised inert fibrous flexible textile material which comprises the steps of (i) impregnating a scoured textile material formed from a blend of a fibrous acrylonitrile polymer and a fibrous regenerated cellulosic material with an aqueous solution of salts selected from the group consisting of (a) ammonium halides and lower copper alkanoates and (b) ammonium phosphates and alkali metal bichromates, (ii) heating the impregnated material in a stream of an oxygen-containing gas to a temperature within the range of 150° to 250° C. for from 80 to 120 minutes and thereafter (iii) heating the thus treated material in a flowing inert gas atmosphere so as to produce a surface temperature on the fibres of 275° to 325° C. for a time sufficient to render the surfaces of the fibres substantially uniformly inert.

2. The process of claim 1 in which said scoured textile material is a blend of 70–30% of acrylonitrile polymer and 30–70% of regenerated cellulosic material.

3. The process of claim 1 in which said scoured textile material is a blend of substantially equal proportions of acrylonitrile polymer and regenerated cellulosic material.

4. The process of claim 1 in which said acrylonitrile polymer is a polyacrylonitrile.

5. The process of claim 1 in which said scoured textile material is a scoured woven textile material.

6. The process of claim 1 in which in step (ii) said heating commences at 150° C. and the temperature is gradually increased during the course of 80–120 minutes to 250° C.

7. The process of claim 6 in which during said heating the material being treated is maintained under longitudinal tension.

8. The process of claim 1 in which in step (iii) said heating is effected by infra-red ray treatment for a time sufficient to render the surfaces of the fibres substantially black and substantially uniformly inert whilst retaining their flexibility.

9. The process of claim 1 in which in step (iii) said heating is for 1 to 2 hours.

10. A partially carbonised, fibrous, flexible inert textile material which has been produced by a process which comprises the steps of (i) impregnating a scoured textile material formed from a blend of a fibrous acrylonitrile polymer and a fibrous regenerated cellulosic material with an aqueous solution of salts selected from the group consisting of (a) ammonium halides and lower copper alkanoates and (b) ammonium phosphates and alkali metal bichromates, (ii) heating the impregnated material in a stream of an oxygen-containing gas to a temperature within the range of 150° to 250° C. for from 80 to 120 minutes and thereafter (iii) heating the thus treated material in a flowing inert gas atmosphere so as to produce a surface temperature on the fibres of 275° to 325° C. for a time sufficient to render the surfaces of the fibres substantially uniformly inert.

* * * * *